2/11/86 OR 4,569,760

United States Patent [19]

Aufderhaar et al.

[11] Patent Number: 4,569,760

[45] Date of Patent: Feb. 11, 1986

[54] DISCHARGE SHAFT FOR A VERTICAL CENTRIFUGE

[75] Inventors: Erhard Aufderhaar, Unterschleissheim; Ernst Gruebl, Munich; Siegfried Pfaff, Germering, all of Fed. Rep. of Germany

[73] Assignee: Krauss-Maffei A.G., Fed. Rep. of Germany

[21] Appl. No.: 678,471

[22] Filed: Dec. 5, 1984

[30] Foreign Application Priority Data

Dec. 5, 1983 [DE] Fed. Rep. of Germany ..... 3343937

[51] Int. Cl.[4] ..... B04B 3/00

[52] U.S. Cl. ..... 210/372

[58] Field of Search ..... 210/372, 369; 494/56, 494/59

[56] References Cited

U.S. PATENT DOCUMENTS

| | | | |
|---|---|---|---|
| 1,839,941 | 1/1932 | Zelezniak | 210/369 |
| 2,312,829 | 3/1943 | Bird et al. | 210/369 |
| 2,889,930 | 6/1959 | Tholl et al. | 210/369 |
| 3,302,794 | 2/1967 | Laven | 210/369 |
| 3,814,246 | 6/1974 | Wilson et al. | 210/374 |
| 4,014,497 | 3/1977 | Spiewok et al. | 494/56 |

*Primary Examiner*—Tim Miles

*Attorney, Agent, or Firm*—Robert J. Koch

[57] ABSTRACT

A discharge shaft arrangement is provided for a bottom discharge vertical centrifuge with a filter drum in which a suspension is separated into solids and a filtrate, wherein at least one discharge shaft is provided in the area of the drum hub, under the drum in a base plate. The discharge shaft has an approximately kidney-shaped horizontal cross-section to prevent the deposition of solids.

7 Claims, 5 Drawing Figures

Fig. 2
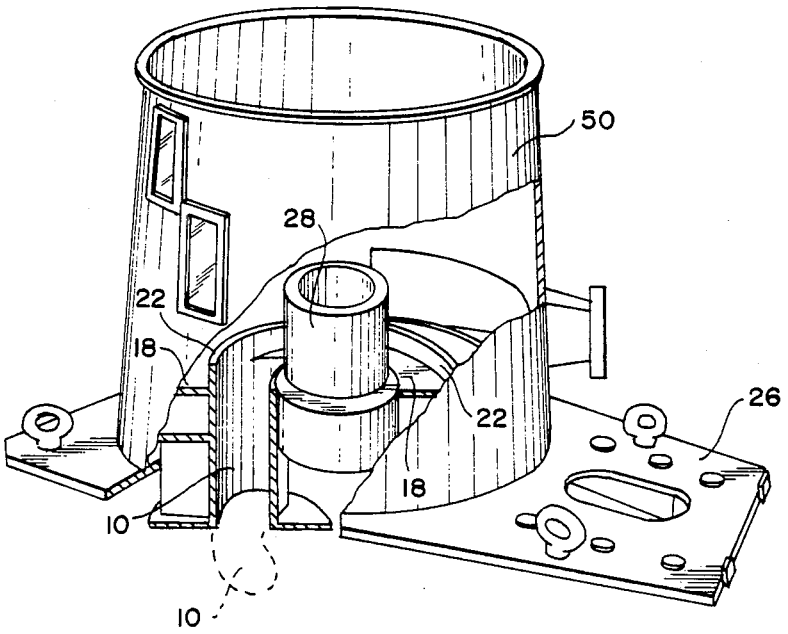
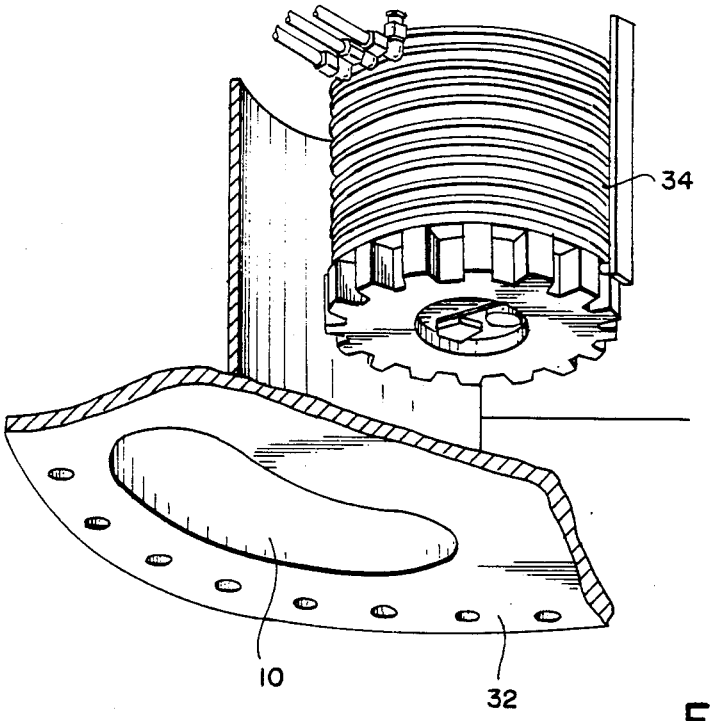
Fig. 3

Fig. 4
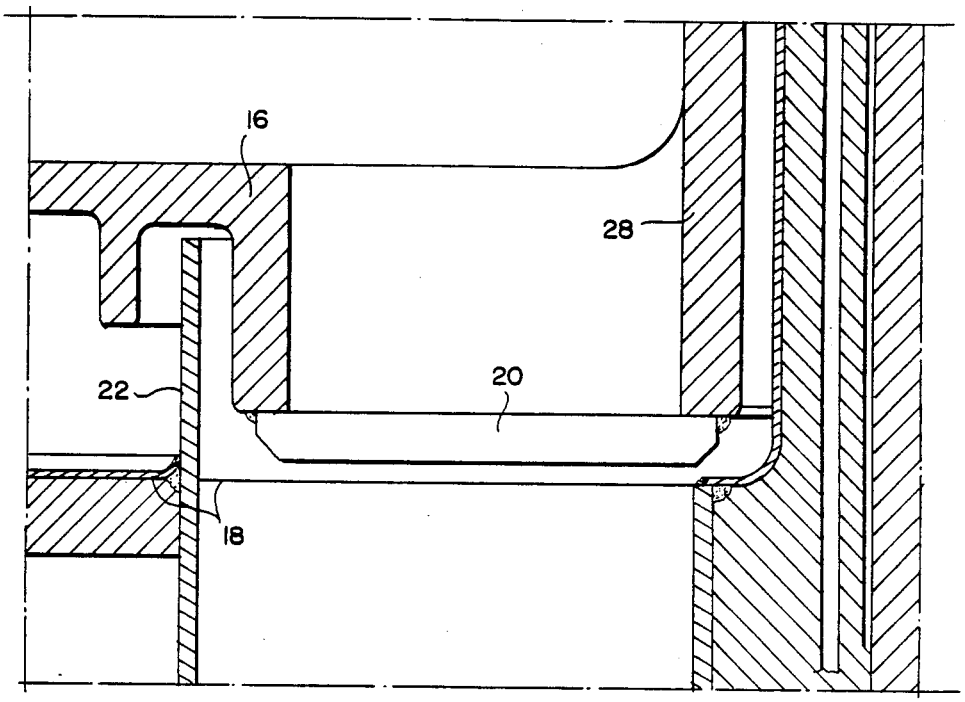
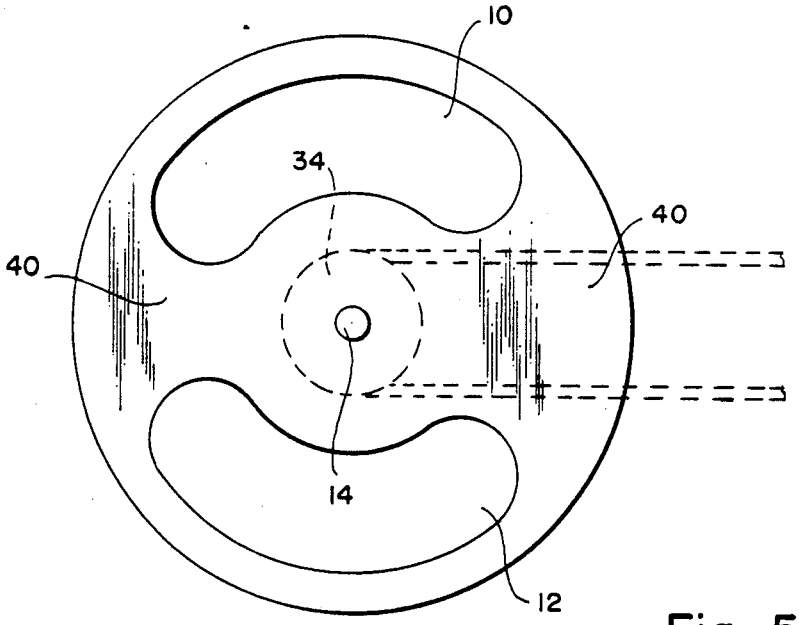
Fig. 5

DISCHARGE SHAFT FOR A VERTICAL CENTRIFUGE

BACKGROUND OF THE INVENTION

The invention relates to a discharge shaft for a bottom discharging vertical centrifuge with a filtration drum. Particularly, the invention relates to a vertical centrifuge, suited for separating a suspension into solids and a filtrate, which comprises at least one discharge shaft under the drum, in a base plate, in the vicinity of a hub of the drum.

The solids remaining in the drum of a vertical centrifuge following the separation process must be removed from the drum and the centrifuge separately from the filtrate. In conventional bottom discharging vertical centrifuges, a discharge shaft for the removal of solids is provided in a base plate located under the drum. In order to be removed from the centrifuge, the solid material may drop down the shaft, possibly after being scraped from the internal wall of the drum.

In the use of centrifuges in the pharmaceutical industry or in the food industry, it is essential that the centrifuge be kept clean. In particular, no solid residues must be permitted to accumulate in inaccessible grooves, recesses and corners of the centrifuge. The discharge shaft is particularly critical in this respect because it is only observable and accessible with difficulty from the manhole for cleaning purposes located in the upper cover plate of the centrifuge. The discharge shaft or shafts usually extend radially outward in the area around the hub of the drum, so that their horizontal cross-sections define an approximately annular region. This annular region is, however, not only occupied by the discharge shafts, but also by drive means (e.g., a V-belt drive) leading to the drive shaft of the drum. For reasons of keeping the inside of the centrifuge clean, the drive unit must be kept separate and sealed off from the discharge shafts.

SUMMARY OF THE INVENTION

It is an object of the present invention to provide a discharge shaft for a bottom discharging vertical centrifuge of the above-mentioned type, which prevents undesirable solid accumulations and which may be cleaned in a simple manner.

This object is achieved according to the invention in that the discharge shaft has an approximately kidney-shaped horizontal cross-section.

By virtue of the kidney shape of the discharge shaft, the latter has no corners and edges in which solid residues could accumulate.

According to one embodiment of the present invention, two discharge shafts are arranged opposite each other and symmetrical with respect to the shaft of the drum.

The discharge shafts open into a base plate with their upper ends. The base plate also separates the drive unit from the inside of the centrifuge, among other things. In another embodiment according to the invention, solids accumulating on the base plate are pushed into the discharge shafts by means of raking blades which rotate directly above the base plate.

The solids generated by the separating process remain in the drum and are then led to the discharge shaft by scraping, if necessary. The filtrate passes through the filtering drum wall and finally also migrates in the direction of the base plate. In a further development of the invention a labyrinth ring is provided on the base plate in order to keep the solids and the filtrate from again becoming mixed. In this embodiment, the discharge shafts are located on the radially inward side of the labyrinth ring.

Further objects, features and advantages of the present invention will become apparent from the detailed description of preferred embodiments which follows, when considered together with the attached figures of drawings.

BRIEF DESCRIPTION OF THE DRAWINGS

FIG. 2 shows a detailed view of the discharge shaft region in the vertical centrifuge of FIG. 1;

FIG. 3 shows a bottom view of a discharge shaft and a V-belt pulley from below the discharge shaft;

FIG. 4 shows a section through a part of the drum, the base plate and one raker blade; and FIG. 5 shows a horizontal cross-section below the base plate of the centrifuge through the discharge shafts and the V-belt pulley.

Figure 1:
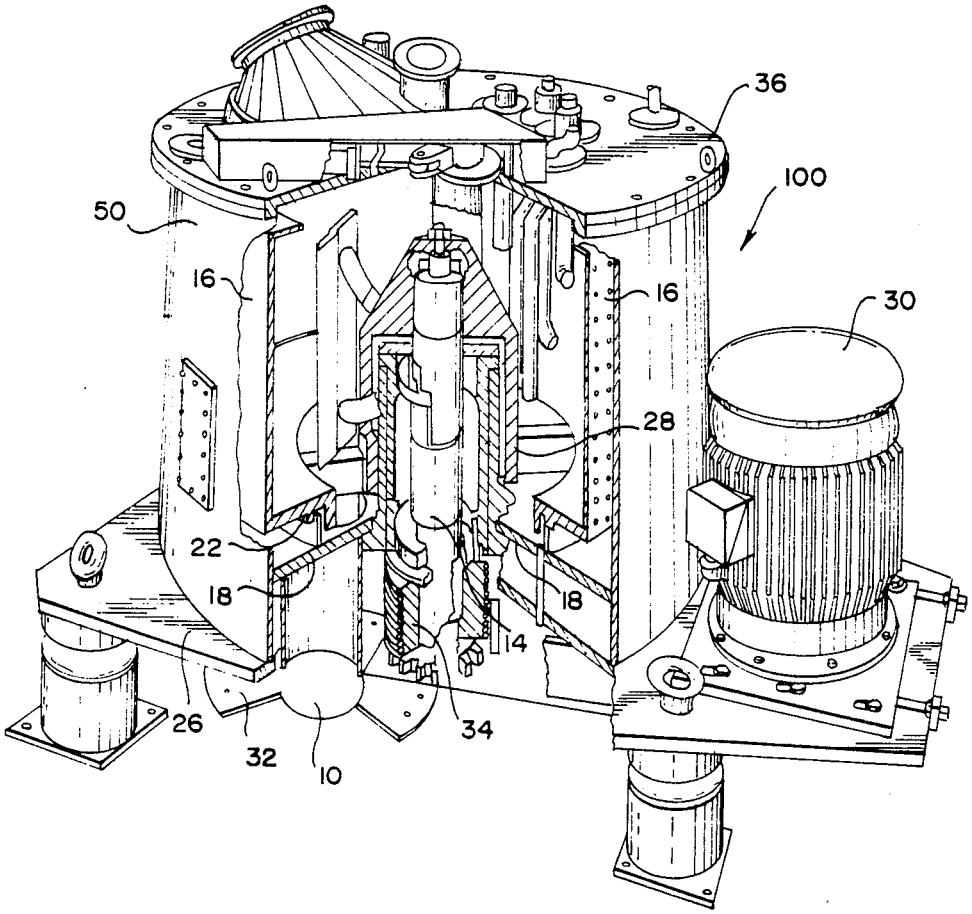
FIG. 1 shows a perspective view of a bottom discharging vertical centrifuge.

According to FIG. 1, the vertical centrifuge 100 has an approximately conical housing 50 which is closed off on top by a cover plate 36. Various installations (such as viewing windows, filler tubes, manholes, etc.), which are not essential for the present invention, are located in the cover plate 36. The drum 16 of the vertical centrifuge 100 is driven by means of a motor 30, a V-belt acting on a V-belt pulley 34, and the shaft 14. The hub 28 of the drum 16 rotates with the shaft 14. The conical housing 50 of the vertical centrifuge 100 is anchored on a ground plate 26. The ground plate is supported elastically.

Underneath the drum 16, a horizontally extending base plate 18 passes partially through the housing 50 of the centrifuge 100 (see FIG. 2). A labyrinth ring 22, which separates the solids accruing on the inner side of the drum 16 from the filtrate gathering on the outside of the drum 16, protrudes from the base plate 18. Orifices in the base plate 18 lead into the discharge shaft 10 from radially inside the labyrinth ring 22. As can be particularly seen in FIGS. 2 and 5, the discharge shaft 10, together with a second discharge shaft 12, have kidney-shaped horizontal cross-sections; they have no edges or recesses in which solids could be deposited.

FIG. 3 shows a bottom view toward the flange 32. The discharge shaft 10 opens with its lower end into a flange 32. The flange 32 may be connected with conduits or containers, into which the separated solids may be led away from the centrifuge. As may also be seen in FIG. 5, the V-belt pulley 34 for driving the shaft 14 is arranged radially within the inner wall of the discharge shafts 10 and 12. The V-belts leading from the shaft (not shown) of the motor to the V-belt pulley 34 are conducted through the clearances 40 between the discharge shafts 10 and 12. The walls of the discharge shafts 10 and 12 and the base plate 18 are completely sealed and permit no communication between the drive area and the inside of the centrifuge.

In order to push the solids falling onto the base plate into the discharge shafts 10 and 12, according to FIG. 4, raker blades 20 are provided on the drum 16 and on its hub 28, respectively. The raker blades 20 rotate directly above the base plate 18, so that the solids are swept into the discharge shafts.

What is claimed is:

1. A discharge shaft arrangement for discharging solids separated from a suspension of solids and a filtrate by a bottom discharging vertical centrifuge having a drum, a hub on said drum, a shaft about which the drum rotates and a base plate under the drum, wherein said discharge shaft arrangement comprises:

at least one discharge shaft disposed near the hub of the drum, and having an approximately kidney-shaped cross-section.

2. A discharge shaft arrangement according to claim 1, further comprising two discharge shafts arranged opposite one another and symmetrical with respect to said drum shaft.

3. A discharge shaft arrangement according to claim 1, further comprising a plurality of raker blades mounted for rotation above said base plate and to sweep solids into said discharge shaft.

4. A discharge shaft arrangement according to claim 1, further comprising a labyrinth ring for separating the solids and the filtrate, and wherein said discharge shaft is arranged radially inside the labyrinth ring.

5. A discharge shaft arrangement according to claim 1, wherein the discharge shaft comprises:

a radially inward side defined by a circular arc section concentric with the shaft of the drum;

a radially outward side defined by a circular arc section concentric with the shaft of the drum; and two sides which are spaced apart in the direction of rotation, and each of which is defined by a circular arc that is tangential to both the radially outward and radially inward sides.

6. A discharge shaft arrangement according to claim 2, wherein the two discharge shafts are symmetrically arranged about a mirror plane passing through the shaft of the drum, and wherein the clearance between the discharge shafts in the direction of rotation is greater on one side than the other.

7. A discharge shaft arrangement according to claim 1, comprising a plurality of discharge shafts distributed circumferentially about the drum shaft.

* * * * *